US008264351B1

(12) United States Patent
Nacey

(10) Patent No.: US 8,264,351 B1
(45) Date of Patent: Sep. 11, 2012

(54) SECURITY ALARM SYSTEM

(76) Inventor: Edward L. Nacey, St. Petersburg, FL (US)

( * ) Notice: Subject to any disclaimer, the term of this patent is extended or adjusted under 35 U.S.C. 154(b) by 642 days.

(21) Appl. No.: 12/387,337

(22) Filed: May 1, 2009

(51) Int. Cl.
*G08B 13/14* (2006.01)

(52) U.S. Cl. ..... 340/568.1; 340/984; 340/5.31; 340/5.2; 340/3.1

(58) Field of Classification Search ..... 340/984, 340/568.1, 5.31, 5.21, 825.31, 3.1, 3.7, 3.9, 340/5.3, 5.32; 187/392
See application file for complete search history.

(56) References Cited

U.S. PATENT DOCUMENTS

| | | | | |
|---|---|---|---|---|
| 3,602,042 | A * | 8/1971 | Mitchell | 73/126 |
| 3,657,737 | A * | 4/1972 | Hamm et al. | 340/629 |
| 4,785,914 | A * | 11/1988 | Blain et al. | 187/280 |
| 5,343,739 | A * | 9/1994 | Curry | 212/280 |
| 6,257,159 | B1 * | 7/2001 | Siegmann | 114/45 |
| 6,707,374 | B1 * | 3/2004 | Zaharia | 340/5.31 |
| 2005/0182522 | A1 * | 8/2005 | Chase | 700/275 |
| 2005/0183648 | A1 * | 8/2005 | Basta | 114/44 |
| 2007/0086879 | A1 * | 4/2007 | Goodrich et al. | 414/537 |

* cited by examiner

*Primary Examiner* — Hoi Lau

(57) ABSTRACT

A drive assembly has a controller for moving an object. A security reset button initiates and terminates security functions for the system. An alarm is provided. A circuit assembly includes a first circuit for moving the object. The circuit assembly includes a second circuit for generating the alarm in response to unauthorized moving of the object.

3 Claims, 2 Drawing Sheets

FIG 1
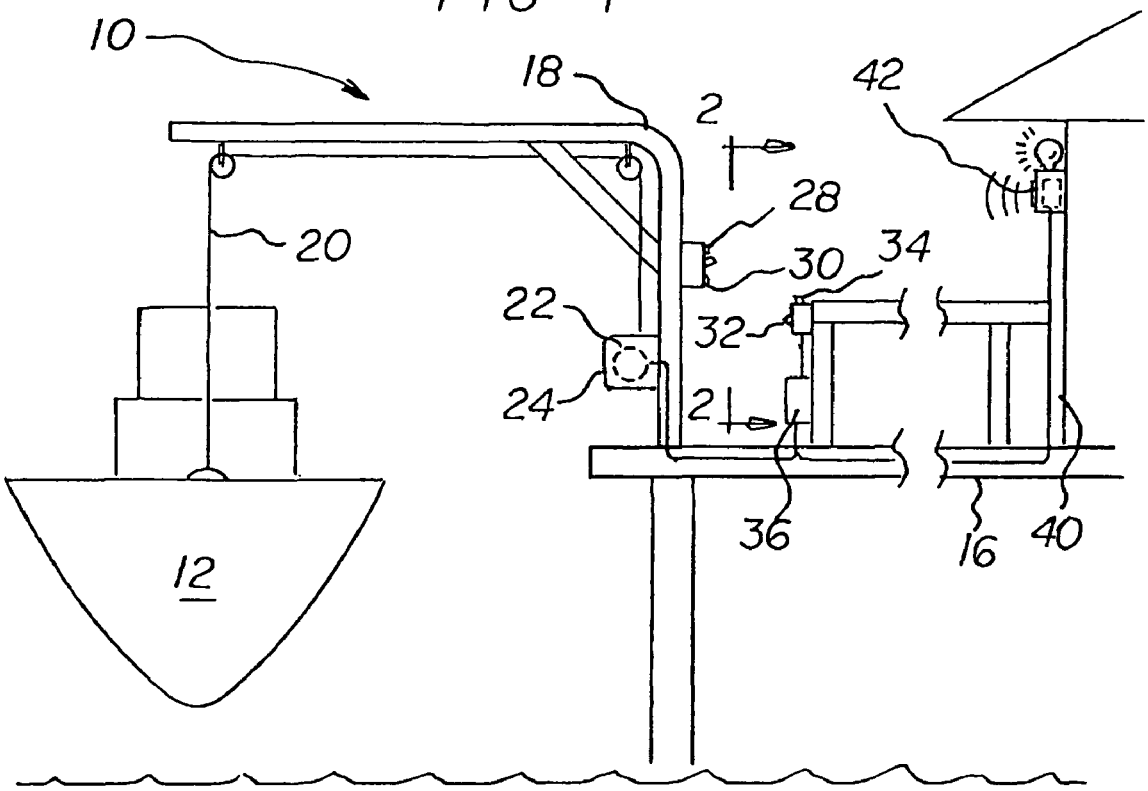
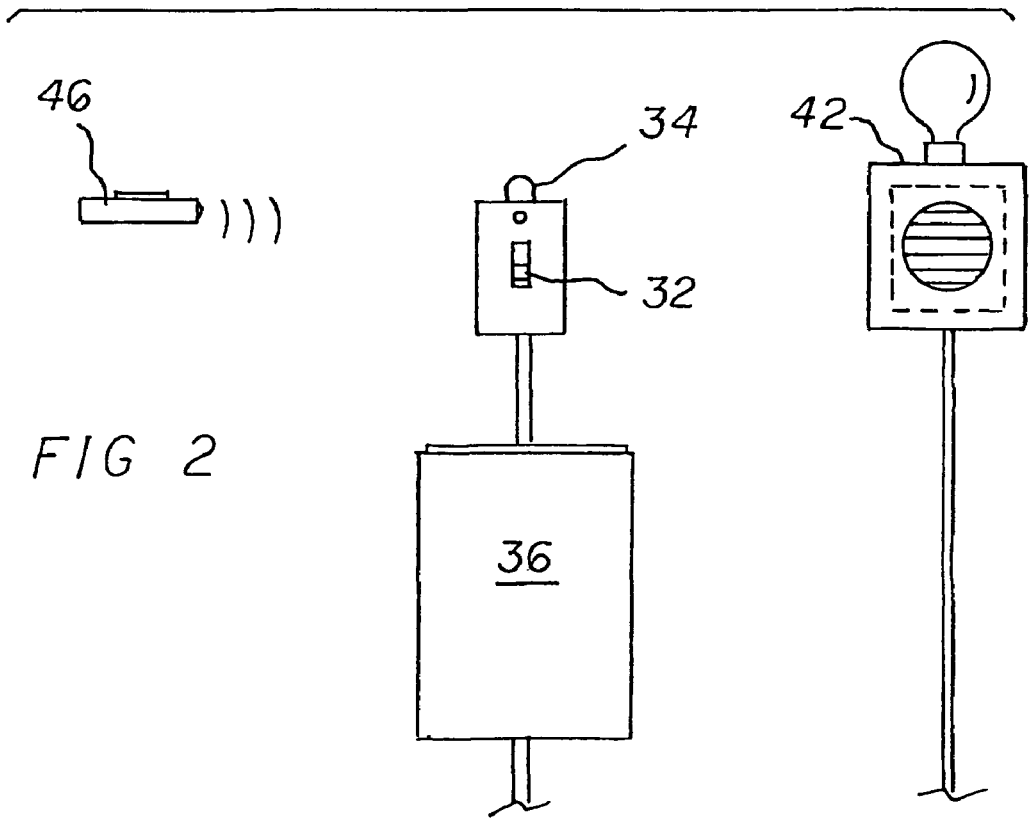
FIG 2

SECURITY ALARM SYSTEM

BACKGROUND OF THE INVENTION

Field of the Invention

The present invention relates to a security alarm system and more particularly pertains to generating an alarm in the event of an attempted theft.

SUMMARY OF THE INVENTION

In view of the disadvantages inherent in the known types of boat lifts, garage door openers and the like of known designs and configurations now present in the prior art, the present invention provides an improved security alarm system. As such, the general purpose of the present invention, which will be described subsequently in greater detail, is to provide a new and improved security alarm system and method which has all the advantages of the prior art and none of the disadvantages.

To attain this, the present invention essentially comprises a security alarm system. First provided is a boat. The boat is movable between a raised position above water and a lowered position on the water.

A pier is provided. The pier is adjacent to the water. The pier has supports. The pier has a cable. The cable has a first end. The first end of the cable is coupled to the boat. The cable has a second end. The pier has a reel. The reel receives the second end of the cable. The reel has a motor. The reel has controls. The controls include a lift switch. The controls include an up button. In this manner the boat is raised. The controls include a down button. In this manner the boat is lowered. The controls also include a security reset switch. In this manner the security functions for the system are initiated and terminated. A pier alarm is provided. The pier alarm is provided in the form of an audio-visual signal. The audio-visual signal is adapted to generate an alarm in the event of an attempted unauthorized use of the system. A breaker box is provided. The breaker box is operatively coupled with the lift switch and the security reset button.

Provided next is a dwelling. The dwelling is remote from the pier. The dwelling has a dwelling alarm. The dwelling alarm is in the form of an audio alarm and a strobe light and a security notifier.

A circuit assembly is provided. The circuit assembly is adapted to raise and lower the boat. The circuit assembly is also adapted to generate the pier alarm and dwelling alarm in response to unauthorized raising and lowering of the boat. The circuit assembly includes a 220 volt alternating current first circuit. In this manner the boat is raised and lowered. The circuit assembly includes an applicable voltage second circuit. In this manner the pier alarm is generated in response to unauthorized raising and lowering of the boat. The circuit assembly also includes a 24 volt direct current third circuit. In this manner the dwelling alarm is generated in response to unauthorized raising and lowering of the boat.

The first circuit includes a lift motor. The first circuit also includes a controller with an up button and a down button. The first circuit further includes a lift switch. The lift switch has opposed poles. The lift switch is wired in series with the motor. In this manner the first circuit is opened and closed. The first circuit includes a boat lift relay. The boat lift relay is coupled to the poles of the lift switch in parallel with the lift switch. The lift switch is selectively adapted to be a contactor. A keyless remote is provided. The contactor is adapted to be controlled by the keyless remote.

The second circuit includes a security reset switch. The second circuit also includes a security relay. The security reset switch and security relay are wired in series. The security reset switch is a push-type reset push button. The security reset switch is adapted to reset the pier alarm following activation of the system. The pier alarm is an audio-visual signal. The pier alarm is in parallel with the security relay and in series with the security reset switch. Parallel contacts are provided. The parallel contacts are provided between the security reset switch and the security relay. A contact is provided. The contact is provided in series between the security reset switch and the pier alarm. The security relay is adapted to be picked up by the lift relay for functioning to self hold and energize the pier alarm. The up and down buttons are adapted to be pushed. In this manner the second circuit is opened and closed. Also in this manner the lift relay is caused to pick-up the contact which latches the contacts on the security relay. Further in this manner the pier alarm is activated. An applicable voltage power source is provided for the security relay. The power sources constitutes a power source to the pier alarm. In this manner a power source is provided to the motor independent of the power source to the pier alarm.

The third circuit includes a dwelling alarm. The third circuit also includes a contact operable from the security relay. The contact is in series with the dwelling alarm.

Provided last is a system power source. The system power source includes a transformer. The transformer has 110 volt alternating current input lines and output lines. The output lines include a 24 volt alternating current line and a 12 volt alternating current line and a common line. The system power source also includes a full wave bridge rectifier. The full wave bridge rectifier is fed from the transformer. In this manner the first, second and third circuits are powered.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved security alarm system which has all of the advantages of the prior art boat lifts of known designs and configurations and none of the disadvantages.

It is another object of the present invention to provide a new and improved security alarm system which may be easily and efficiently manufactured and marketed.

It is further object of the present invention to provide a new and improved security alarm system which is of durable and reliable constructions.

An even further object of the present invention is to provide a new and improved security alarm system which is susceptible of a low cost of manufacture with regard to both materials and labor, and which accordingly is then susceptible of low prices of sale to the consuming public, thereby making such security alarm system economically available to the buying public.

Even still another object of the present invention is to provide a security alarm system for generating an alarm in the event of an attempted theft and precluding the unauthorized inactivation of the alarm.

Lastly, it is an object of the present invention to provide a new and improved security alarm system. A drive assembly has a controller for moving an object. A security reset button initiates and terminates security functions for the system. An alarm is provided. A circuit assembly includes a first circuit for moving the object. The circuit assembly includes a second circuit for generating the alarm in response to unauthorized moving of the object.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a boat lift and security alarm system constructed in accordance with the principles of the invention.

FIG. 2 is a side elevational view taken along line 2-2 of FIG. 1.

The same reference numerals refer to the same parts throughout the various Figures.

DESCRIPTION OF THE PREFERRED EMBODIMENT

Figure 3:
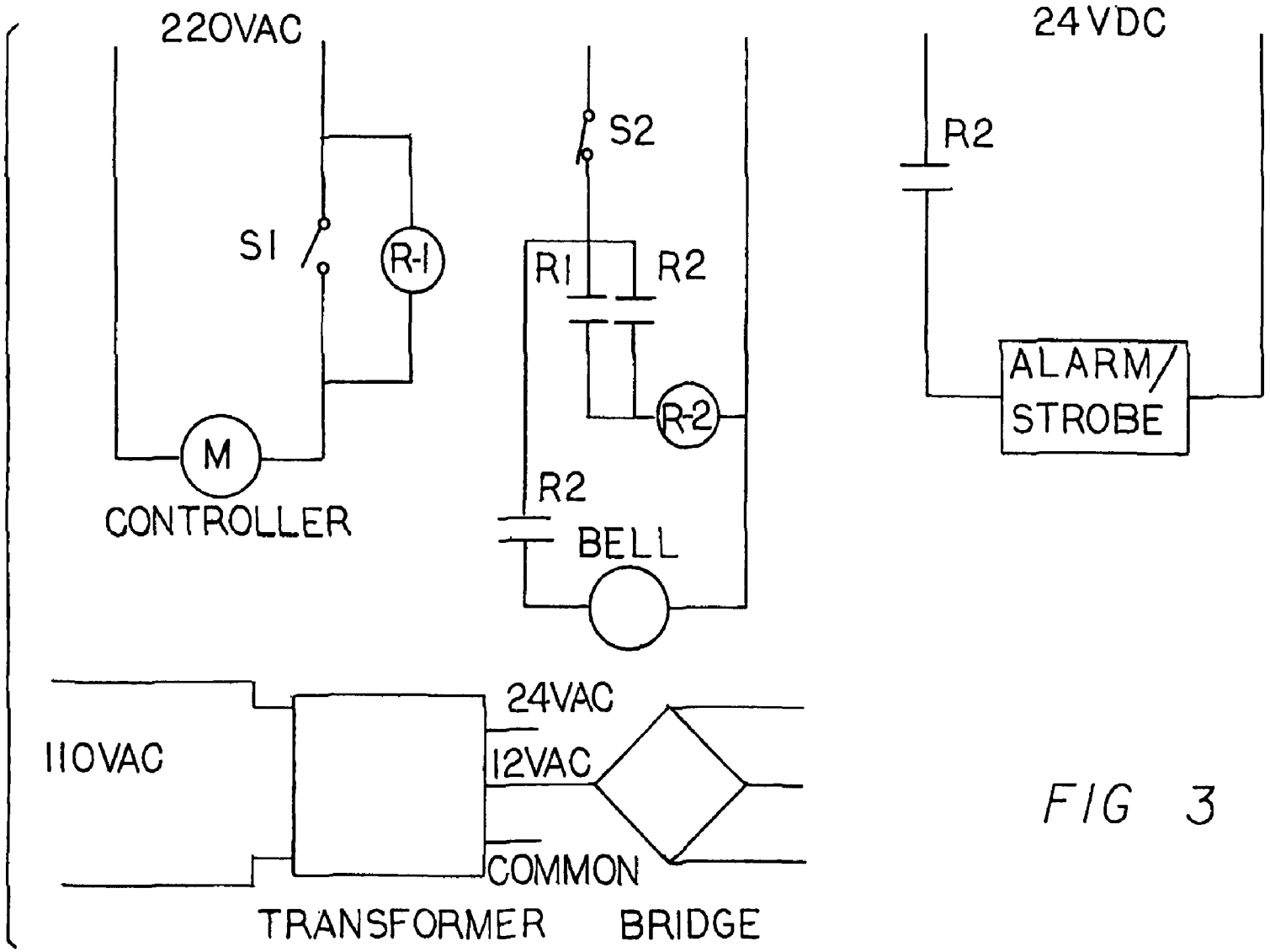
FIG. 3 is a schematic illustration of circuit diagrams for various sections of the invention.

With reference now to the drawings, and in particular to FIG. 1 thereof, the preferred embodiment of the new and improved security alarm system embodying the principles and concepts of the present invention and generally designated by the reference numeral 10 will be described.

The present invention, the security alarm system 10 is comprised of a plurality of components. Such components in their broadest context include a boat lift and a circuit assembly. Such components are individually configured and correlated with respect to each other so as to attain the desired objective.

First provided is a boat 12. The boat is movable between a raised position above water and a lowered position on the water.

A pier 16 is provided. The pier is adjacent to the water. The pier has supports 18. The pier has a cable 20. The cable has a first end. The first end of the cable is coupled to the boat. The cable has a second end. The pier has a reel 22. The reel receives the second end of the cable. The reel has a motor 24. The reel has controls. The controls include a lift switch SW1. The controls include an up button 28. In this manner the boat is raised. The controls include a down button 30. In this manner the boat is lowered. The controls also include a security reset switch S2. In this manner the security functions for the system are terminated. A pier alarm 34 is provided. The pier alarm is provided in the form of an audio-visual signal. The audio-visual signal is adapted to generate a signal in the event of an attempted unauthorized use of the system. A breaker box 36 is provided. The breaker box is operatively coupled with the lift switch and the security reset button.

Provided next is a dwelling 40. The dwelling is remote from the pier. The dwelling has a dwelling alarm 42. The dwelling alarm is in the form of an audio alarm and a strobe light and a security notifier.

A circuit assembly is provided. The circuit assembly is adapted to raise and lower the boat. The circuit assembly is also adapted to generate the pier alarm and dwelling alarm in response to unauthorized raising and lowering of the boat. The circuit assembly includes a 220 volt alternating current first circuit. In this manner the boat is raised and lowered. The circuit assembly includes an applicable voltage second circuit. In this manner the pier alarm is generated in response to unauthorized raising and lowering of the boat. The circuit assembly also includes a 24 volt direct current third circuit. In this manner the dwelling alarm is generated in response to unauthorized raising and lowering of the boat.

The first circuit includes a lift motor M. The first circuit also includes a controller with an up button and a down button. The first circuit further includes a lift switch. The lift switch has opposed poles. The lift switch is wired in series with the motor. In this manner the first circuit is opened and closed. The first circuit includes a boat lift relay R-1. The boat lift relay is coupled to the poles of the lift switch in parallel with the lift switch. The lift switch is selectively adapted to be a contactor. A keyless remote 46 is provided. The contactor is adapted to be controlled by the keyless remote.

The second circuit includes a security reset switch S2. The second circuit also includes a security relay R-2. The security reset switch and security relay are wired in series. The security reset switch is a push-type reset push button. The security reset switch is adapted to reset the pier alarm following activation of the system. The pier alarm is an audio-visual signal. The pier alarm is in parallel with the security relay and in series with the security reset switch. Parallel contacts R1, R2 are provided. The parallel contacts are provided between the security reset switch and the security relay. A contact R2 is provided. The contact is provided in series between the security reset switch and the pier alarm. The security relay is adapted to be picked up by the lift relay for functioning to self hold and energize the pier alarm. The up and down buttons are adapted to be pushed. In this manner the second circuit is opened and closed. Also in this manner the lift relay is caused to pick-up the contact which latches the contacts on the security relay. Further in this manner the pier alarm is activated. An applicable voltage power source is provided for the security relay. The power sources constitutes a power source to the pier alarm. In this manner a power source is provided to the motor M independent of the power source to the pier alarm.

The third circuit includes a dwelling alarm. The third circuit also includes a contact operable from the security relay. The contact is in series with the dwelling alarm.

Provided last is a system power source. The system power source includes a transformer. The transformer has 110 volt alternating current input lines and output lines. The output lines include a 24 volt alternating current line and a 12 volt alternating current line and a common line. The system power source also includes a full wave bridge rectifier. The full wave bridge rectifier is fed from the transformer. In this manner the first, second and third circuits are powered.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A security alarm system comprising:

a drive assembly with a controller for moving an object, a security reset button for terminating alarm functions for the system, and an alarm; and a circuit assembly including a first circuit for moving the object and a second circuit for generating the alarm in response to unauthorized moving of the object;

the first circuit including a motor and a controller with an up button and a down button, a lift switch with opposed poles in series with the motor functioning to open and close the first circuit, an object lift relay coupled in parallel to the poles of the lift switch, and the lift switch being selectively adapted to be a contactor adapted to be controlled by a keyless remote;

the second circuit including a security reset switch and a security relay wired in series, the security reset switch being a push-type reset push button adapted to reset the alarm following activation of the system, the alarm being an audio-visual signal in parallel with the security relay and in series with the security reset switch, parallel contacts between the security reset switch and the security relay, a contact in series between the security reset button and the alarm, the security relay adapted to be picked up by the lift relay for functioning to self hold and energize the alarm, up and down buttons adapted to be pushed for opening and closing the second circuit and for causing the lift relay to pick up, the lift relay functioning to pick up the contact latching the contacts on the security relay which then activates the alarm, an applicable voltage power source for the security relay constituting a power source to the alarm whereby a power source to the motor is independent of the power source to the alarm.

2. The system as set forth in claim 1 and further including a third circuit including a dwelling alarm and wherein the contact is in series with the dwelling alarm, the dwelling alarm including an audio alarm and a strobe light and a security notifier.

3. A boat lift security and alarm system for generating an alarm in the event of an attempted theft and for precluding the unauthorized inactivation of the alarm, the system comprising, in combination:

a boat movable between a raised position above water and a lowered position on the water;

a pier adjacent to the water, the pier having supports with a cable having a first end coupled to the boat and a second end, a reel receiving the second end of the cable, the reel having a motor and controls, the controls including a lift switch and an up button for raising the boat and a down button for lowering the boat, a security reset switch for terminating alarm functions for the system, a pier alarm in the form of an audio-visual signal adapted to generate an alarm in the event of an attempted unauthorized use of the system, a breaker box operatively coupled with the lift switch and the security reset switch;

a dwelling remote from the pier, the dwelling having a dwelling alarm in the form of an audio alarm and a strobe light and a security notifier;

a circuit assembly including a lift motor with a controller and a first lift switch adapted to raise and lower the boat, the circuit assembly also adapted to generate the pier alarm and dwelling alarm in response to unauthorized raising and lowering of the boat, the circuit assembly including a 220 volt alternating current first circuit for raising and lowering the boat, the circuit assembly including an applicable voltage second circuit for generating the pier alarm in response to unauthorized raising and lowering of the boat, the circuit assembly also including a 24 volt direct current third circuit for generating the dwelling alarm in response to unauthorized raising and lowering of the boat;

the first circuit including the lift motor and the controller with the up button and the down button, the first lift switch having opposed poles, the first lift switch being wired in series with the motor for functioning to open and close the first circuit, a boat lift relay coupled in parallel with the first lift switch, the first lift switch selectively adapted to be a contactor, the contactor adapted to be controlled by a keyless remote;

the second circuit including the security reset switch and a security relay wired in series, the security reset switch being a push-type reset push button adapted to reset the pier alarm following activation of the system, the pier alarm being an audio-visual signal in parallel with the security relay and in series with the security reset switch, parallel contacts between the security reset switch and the security relay, a contact in series between the security reset switch and the pier alarm, the security relay adapted to be picked up by the lift relay for functioning to self hold and energize the pier alarm, the up and down buttons adapted to be pushed for opening and closing the second circuit and for causing the lift relay to pick up, the lift relay functions to pick up the contact which latches the contacts on the security relay which then activates the pier alarm, an applicable voltage power source for the security relay constituting a power source to the pier alarm whereby a power source to the motor M is independent of the power source to the pier alarm; and the third circuit including the dwelling alarm and the contact operable from the security relay, the contact being in series with the dwelling alarm; and a system power source including a transformer with 110 volt alternating current input lines and output lines, the output lines including a 24 volt alternating current line and a 12 volt alternating current line and a common line, a full wave bridge rectifier fed from the transformer for powering the first, second and third circuits.

* * * * *